US007404503B1

(12) United States Patent
Cleaver et al.

(10) Patent No.: US 7,404,503 B1
(45) Date of Patent: Jul. 29, 2008

(54) COMPACT CLOTHES HANGER

(76) Inventors: Andrew Cleaver, 13823 Nueces Springs La., Cypress, TX (US) 77429; Myron D Osborn, 13823 Nueces Springs La., Cypress, TX (US) 77429

( * ) Notice: Subject to any disclaimer, the term of this patent is extended or adjusted under 35 U.S.C. 154(b) by 0 days.

(21) Appl. No.: 11/961,626

(22) Filed: Dec. 20, 2007

Related U.S. Application Data

(60) Provisional application No. 60/886,862, filed on Jan. 26, 2007.

(51) Int. Cl.
*A41D 27/22* (2006.01)

(52) U.S. Cl. ..... 223/88; 223/85; 223/91; 223/92; 223/95; 223/96

(58) Field of Classification Search ..... 223/85, 223/87, 88, 91, 92, 93, 95, 96, DIG. 4; 211/85.3, 211/113; D6/318, 319
See application file for complete search history.

(56) References Cited

U.S. PATENT DOCUMENTS 2,303,095 A * 11/1942 Sinclair ..... 223/92
D140,869 S * 4/1945 Powers ..... D6/319
2,571,635 A * 10/1951 Von Gunten ..... 223/88
D171,897 S * 4/1954 La Barrw ..... 223/88
2,806,641 A * 9/1957 Rowe ..... 223/96
D287,085 S * 12/1986 Leeds ..... D6/513
D323,587 S * 2/1992 Primeau ..... D6/327
D330,635 S * 11/1992 Licari ..... D6/319
6,315,176 B1 * 11/2001 Abdi ..... 223/85
D519,157 S * 4/2006 Balatti ..... D19/86

* cited by examiner

*Primary Examiner*—Gary L. Welch
*Assistant Examiner*—Nathan E Durham
(74) *Attorney, Agent, or Firm*—Buskop Law Group, PC; Wendy Buskop

(57) ABSTRACT

A compact clothes hanger having a straight member having a hooked end and an opposite end perpendicularly secured between a first end and a second end disposed opposite the first end of a horizontal top arm. A recessed area centrally disposed between the first end and the second end and operatively aligned with the hooked end.

13 Claims, 2 Drawing Sheets

COMPACT CLOTHES HANGER

CROSS REFERENCE TO RELATED APPLICATION

The present application claims priority to Provisional Application Ser. No. 60/886,862, filed on Jan. 26, 2007. The prior Provisional Application is incorporated by reference along with its appendices.

FIELD

The present embodiments relate generally to a space saving compact clothes hanger, for hanging clothing on a bar.

BACKGROUND

There exists a need for a compact clothes hanger that has a recessed portion aligned with a hooked end allowing for a clothes hanger that is more compact than a conventional clothes hanger increasing the space between the floor and the hanging clothes.

The present embodiments meet these needs.

BRIEF DESCRIPTION OF THE DRAWINGS

The detailed description will be better understood in conjunction with the accompanying drawings.

Figure 1:
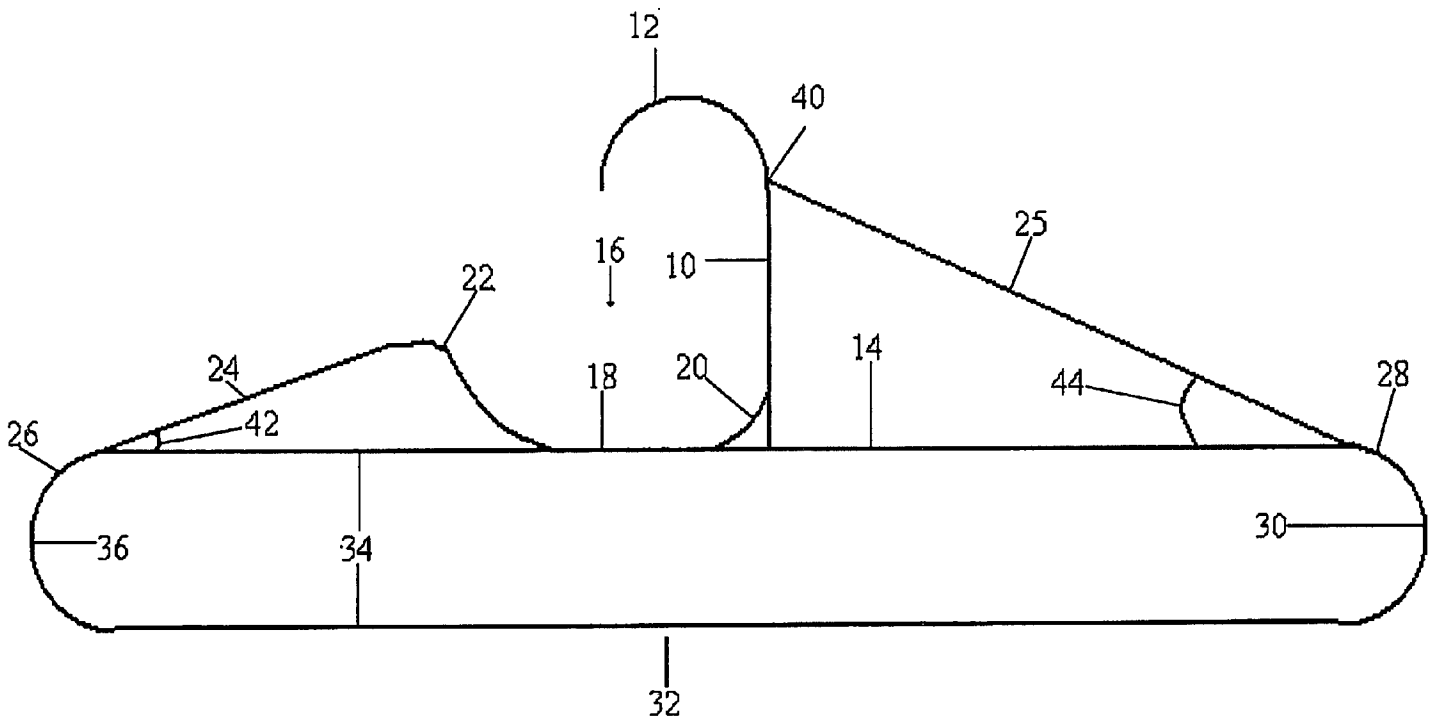
FIG. 1 depicts an embodiment of the compact clothes hanger.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The present embodiments relate generally to a compact clothes hanger. The compact clothes hanger can have a straight member having a hooked end. An opposite end of the straight member can be perpendicularly secured on a horizontal top arm between a first end and a second end, and the second end can be disposed opposite the first end.

The compact clothes hanger can also have a recessed area centrally disposed between the first end and the second end, and aligned with the hooked end so that when the hooked end is placed on a clothing bar, such as a wooden dowel, the clothing bar will be disposed above the recessed area.

The recessed area can have a central body disposed on the vertical top arm between a first end segment and a second end segment. The first end segment is secured to the straight member and the central body.

The second end segment can be secured to the central body opposite the first end segment, and angularly protruding away from the horizontal top arm and the first end segment.

The compact clothes hanger can additionally have a first support rod secured to the first end and to the second end segment at a height approximately between about 20 percent to about 60 percent of the height of the straight member.

In an embodiment of the compact clothes hanger, the compact clothes hanger can also have a second support rod secured to the second end and to the straight member, at a point on the straight member where the hooked end intersects with the straight member.

An alternative embodiment of the compact clothes hanger can have a horizontal bottom arm disposed below the horizontal top arm and secured to the first end and the second end. In this embodiment there is a receiving space formed and disposed between the horizontal bottom arm and the horizontal top arm.

In an embodiment of the compact clothes hanger a first rounded portion can be securely disposed between the horizontal bottom arm and the first end, and a second rounded portion can be securely disposed between the horizontal bottom arm and the second end. The first rounded portion and the second rounded portion can each have a diameter greater than ¼ of an inch.

In another embodiment of the compact clothes hanger, a first vertical segment can be securely disposed between the horizontal bottom arm and the first end, and a second vertical segment can be securely disposed between the horizontal bottom arm and the second end. The first vertical segment and the second vertical segment can have a length greater than ¼ of an inch. The receiving space can have a height greater than ¼ of an inch.

The compact clothes hanger can have a first clip, such as a clothes clip, or another substantially similar device, secured to the horizontal top arm protruding away from the hooked end, and a second clip, which is substantially similar to the first clip, secured to the horizontal top arm protruding away from the hooked end. The first clip and second clip can be adapted to retain clothing.

In an embodiment of the compact clothes hanger the connection of the second end segment to the first support rod can be a curved intersection.

The embodiments of the clothes hanger have the benefit of providing extra space between the hanging clothes and the floor of the storage area. For example when the embodiments of the clothes hanger, as described herein, are used, there is between about 2 inches to about 4 inches of space saved between the floor and the hung clothes when compared to conventional hangers. In a closet that is 24 square inches this can result in an increased usable storage volume of at least 48 cubic inches.

The embodiments of the invention can be better understood with reference to the figures. FIG. 1 depicts an embodiment of the compact clothes hanger. The compact clothes hanger has a straight member 10. The straight member 10 has a hooked end 12 and the another end secured to a horizontal top arm 14. The horizontal top arm 14 can have a length ranging from about 5 inches to about 18 inches, and can be made from wood, plastic, metal, and other substantially similar organic and inorganic materials.

The horizontal top arm 14 has a first end 26 and second end 28. The first end 26 is disposed on the horizontal top arm 14 opposite the second end 28.

The compact clothes hanger, as depicted, has a recessed area 16 centrally disposed on the horizontal top arm 14 and aligned with the hooked end 12 for receiving a clothes hanging bar. The recessed area has a central body 18 with a diameter between about ⅛ of an inch to about 3 inches.

Connected between the central body 18 and the straight member 10 is a first end segment 20. On the other side of the central body 18 is a second end segment 22 secured to the central body 18. The second end segment 22 angularly extends from the central body 18 away from the horizontal top arm 14 and the first end segment 20.

The second end segment 22 is secured to a first support rod 24. The intersection of the second end segment 22 with the first support rod 24 is a curved intersection.

The first support rod 24 can have a length greater than 1 inch. The first support rod 24 is also secured to the first end 26. The first support rod 24 can form a first angle 42 with the horizontal top arm 14 ranging from about 15 degrees to about 35 degrees. The first support rod 24 and second end segment 22 secure to each other to form a height approximately between about 20 percent to about 60 percent of the height of the straight member 10.

A second support rod 25 is secured to the second end 28 and to the straight member 10. The second support rod 25 can have a length greater than 1 inch. The second support rod 25 can form a second angle 44 with the horizontal top arm 14, which is substantially equal to the first angle 42. The second support rod 25 intersects the straight member 10 at a point 40 where the hooked end 12 and the straight member 10 intersect.

Also depicted in this embodiment is a horizontal bottom arm 32. The horizontal bottom arm 32 can be secured to the first end 26 and the second end 28 by the use of first rounded portion 36 and a second rounded portion 30. The rounded portions can have a diameter ranging from about ¼ of an inch to about 2.5 inches.

The first rounded portion 36 and the second rounded portion 30 can be used to secure the horizontal bottom arm 32 to the first end 26 and second end 28 to form a receiving space 34.

The receiving space 34 can have a height greater than ¼ of an inch, and can be used for receiving clothing, such as ties, pants, garments, coats, or other similar items.

In another embodiment, not shown, a first vertical segment can be used to secure the horizontal bottom arm 32 to the first end 26 and a second vertical segment can be used to secure the horizontal bottom arm 32 to the second end 28. It should be noted that if the vertical segments are used, a receiving space 34 is also formed but will have a different shape than what is depicted in the Figures.

Figure 2:
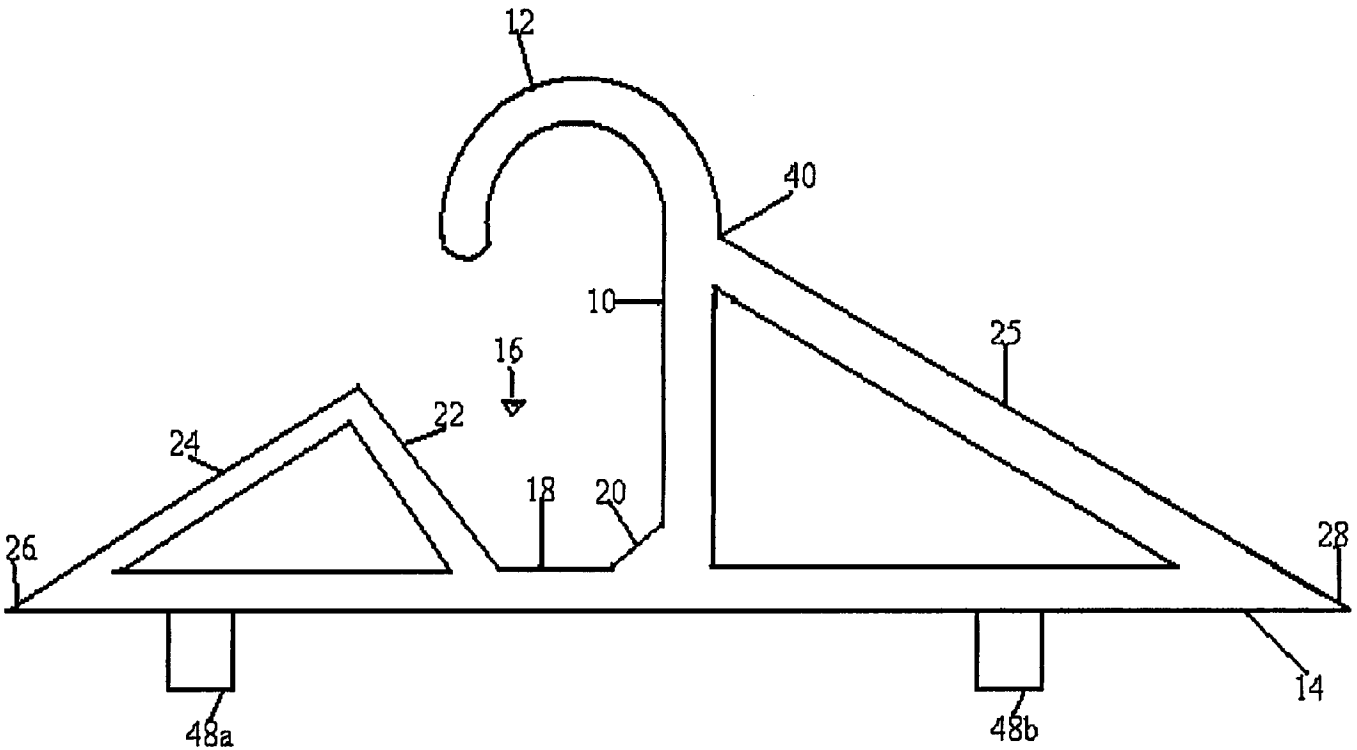
FIG. 2 depicts an alternative embodiment of the compact clothes hanger.

Referring now to FIG. 2, which depicts an alternative embodiment of the compact clothes hanger. The alternative embodiment has the straight member 10 with a hooked end 12, where the other end perpendicular to the top horizontal arm 14 in a substantially similar manner as the embodiment depicted in FIG. 1.

The embodiment in FIG. 2 has the recessed area 16. The embodiment as depicted has the first end segment 20 secured to the straight member 10 and the central body 18. The second end segment 22 is secured to the central body 18 in the same way as depicted in FIG. 1.

The second end segment 22 is secured to a first support rod 24. The first support rod 24 is secured to the first end 26, as depicted in FIG. 1. The second support rod 25 is secured to the second end 28 and to the straight member 10, as depicted in FIG.

In this embodiment a first clip 48*a* and a second clip 48*b* are depicted secured to the top horizontal arm 14. The first clip 48*a* and the second clip 48*b* are adapted to receive clothing.

In an alternative embodiment of the compact clothes hanger the first clip 48*a* and the second clip 48*b* can be removed and the horizontal top arm 14 can be used to hang clothing.

While these embodiments have been described with emphasis on the embodiments, it should be understood that within the scope of the appended claims, the embodiments might be practiced other than as specifically described herein.

What is claimed is:

1. A compact clothes hanger comprising:

a. a horizontal top arm comprising a first end and a second end;

b. a straight member comprising a hooked end and an opposite end perpendicularly secured to a center of the horizontal top arm;

c. a recessed area centrally disposed on the horizontal top arm and operatively aligned with the hooked end;

d. wherein the recessed area comprises a central body centrally disposed on the horizontal top arm, a first end segment disposed between and secured to the straight member and the central body, and a second end segment secured on the opposite side of the central body and angularly protruding away from the horizontal top arm and the first end segment;

e. a first support rod secured to the first end and to the second end segment at a height ranging from between about 20 percent to about 60 percent of the height of the straight member, and a second support rod secured to the second end and secured to the straight member at a point where the hooked end intersects with the straight member; and f. a horizontal bottom arm disposed below the horizontal top arm and operatively secured to the first end and the second end, forming a receiving space disposed between the horizontal bottom arm and the horizontal top arm; forming a hanger with a hooked end with an overall area substantially equal to or less than an overall area of a conventional hanger.

2. The compact clothes hanger of claim 1, wherein the horizontal bottom arm further comprises a first clip secured to the horizontal bottom arm and protruding away from the horizontal top arm and a second clip secured to the horizontal bottom arm and protruding away from the horizontal top arm, wherein the first clip and the second clip are adapted to retain clothing. support rod each comprise a length greater than 1 inch.

3. The compact clothes hanger of claim 2, wherein the receiving space comprises a height greater than ¼ inch.

4. The compact clothes hanger of claim 2, further comprising a first rounded portion securely disposed between the horizontal bottom arm and the first end, and a second rounded portion securely disposed between the horizontal bottom arm and the second end.

5. The compact clothes hanger of claim 4, wherein both the first rounded portion and the second rounded portion each comprise a diameter between about ¼ of an inch to about 2.5 inches.

6. The compact clothes hanger of claim 2, further comprising a first vertical segment securely disposed between the horizontal bottom arm and the first end, and a second vertical segment securely disposed between the horizontal bottom arm and the second end.

7. The compact clothes hanger of claim 6, wherein the first vertical segment and the second vertical segment comprise a length greater than ¼ of an inch.

8. The compact clothes hanger of claim 1, wherein the connection of the second end segment to the first support rod is a curved intersection.

9. The compact clothes hanger of claim 1, wherein the first support rod and the second

10. A compact clothes hanger comprising:

a. a horizontal top arm comprising a first end and a second end;

b. a straight member comprising a hooked end and an opposite end perpendicular secured to the horizontal top arm;

c. a recessed area centrally disposed between the first end and the second end and operatively aligned with the hooked end;

d. wherein the recessed area comprises a central body centrally disposed on the horizontal top arm, a first end segment disposed between and secured to the straight member and the central body, and a second end segment secured on the opposite side of the central body and angularly protruding away from the horizontal top arm and the first end segment; and e. a first support rod secured to the first end and to the second end segment at a height ranging from between about 20 percent to about 60 percent of the height of the straight member, and a second support rod secured to the second end and secured to the straight member at a point where the hooked end intersects with the straight member, forming a hanger with a hooked end with an overall area substantially equal to or less than an overall area of a conventional hanger.

11. The compact clothes hanger of claim 10, further comprising a first clip disposed on the horizontal top arm protruding away from the hooked end and a second clip disposed on the horizontal top arm protruding away from the hooked end, wherein the first clip and the second clip are adapted for securing clothing.

12. The compact clothes hanger of claim 10, wherein the first support rod and the second support rod comprise a length greater than 1 inch.

13. The compact clothes hanger of claim 10, wherein the connection of the second end segment to the first support rod is a curved intersection.

* * * * *